US007144149B2

(12) United States Patent
Grandi et al.

(10) Patent No.: US 7,144,149 B2
(45) Date of Patent: Dec. 5, 2006

(54) HOMOGENIZATION VALVE

(75) Inventors: Simone Grandi, Parma (IT); Marco Gandini, Parma (IT)

(73) Assignee: Niro-Soavi S.p.A., Parma (IT)

( * ) Notice: Subject to any disclaimer, the term of this patent is extended or adjusted under 35 U.S.C. 154(b) by 95 days.

(21) Appl. No.: 10/772,265

(22) Filed: Feb. 6, 2004

(65) Prior Publication Data

US 2005/0083779 A1 Apr. 21, 2005

(30) Foreign Application Priority Data

Oct. 15, 2003 (IT) ..... PR2003A0089

(51) Int. Cl.
*B01F 5/06* (2006.01)

(52) U.S. Cl. ..... 366/176.2; 137/601.01

(58) Field of Classification Search ..... 366/176.2, 366/336–341; 138/43, 45, 46; 137/601.01
See application file for complete search history.

(56) References Cited

U.S. PATENT DOCUMENTS 2,304,689 A * 12/1942 Hanson ..... 138/42
2,882,025 A * 4/1959 Loo ..... 366/340
2,957,496 A * 10/1960 Bartnik ..... 138/43
5,217,037 A * 6/1993 Bristol ..... 137/14
5,887,971 A * 3/1999 Gandini et al. ..... 366/176.2
5,899,564 A * 5/1999 Kinney et al. ..... 366/176.2
6,106,145 A * 8/2000 Winslow ..... 366/176.2
6,234,206 B1 * 5/2001 Malmberg et al. ..... 137/625.33
2004/0071044 A1 * 4/2004 Kozyuk ..... 366/176.2

* cited by examiner

*Primary Examiner*—David Sorkin
(74) *Attorney, Agent, or Firm*—Arent Fox PLLC

(57) ABSTRACT

A homogenization valve comprises an outer case, a homogenization mechanism contained in the outer case and having at least one homogenization device. The homogenization device comprises a high pressure chamber, in communication with a chamber for feeding the high pressure fluid to be homogenized, a low pressure chamber in communication with a channel for discharging the low pressure homogenized fluid. The high pressure chamber is connected to the low pressure chamber by means of a fluid blow-by port. The valve comprises at least two distinct homogenization devices connected in parallel with a same feeding channel and with a same discharge channel.

11 Claims, 6 Drawing Sheets

HOMOGENIZATION VALVE

BACKGROUND OF THE INVENTION

The present invention relates to the field of homogenizing apparatuses.

The homogenization process has the function of reducing the dimensions of the drops of an emulsion, or of the particles of a suspension, and to make them as homogeneous and identical to each other as possible. The homogenization process generally comprises the passage (blow-by) of the fluid to be homogenized, under appropriate pressure, through a nozzle or a very narrow passage, to cause impacts and subdivisions of the particles; preferably, the flow of particles exiting at high speed from said passage is made to impact against an obstacle located at a short distance from the passage, which further contributes to reduce the dimensions of the particles and improve homogenization.

In this field the Applicant has already obtained the Italian patent IT 1.282.765, and filed the corresponding European patent application, publication EP 0.810.025, with the disclosure of an improved homogenization valve.

Essentially, the aforesaid valve comprises two consecutive coaxial annular chambers, separated by a nozzle with radial profile whose height is governed by a pressure means acting in the axial direction against a piston sliding axially within said chambers whereof it defines the radially interior wall: this valve allows to use high pressures for feeding the fluid to be homogenized, to over 1000 bar, minimizing the force needed to maintain the dimensions of the nozzle, whilst providing a product with high quality characteristics. The Applicant has now set the goal of increasing the flow rate of the valve whilst maintaining all other conditions equal, i.e. without increasing the size of the valve and the applied pressure, maintaining constant or improving the efficiency of the homogenization, i.e. the quality of the final product.

The problem is not an easy one to solve because it is not possible simply to increase the size of the nozzles, nor is it sufficient to multiply their number, since both these measures either fail to achieve the desired result or compromise the quality characteristics of the finished product or unacceptably raise the cost of the valve. In particular, in the case of an increase in the number of nozzles, the degree of homogenization and the consistency of the result are compromised because it is impossible to maintain the same fluid feeding pressure: this inequality of pressure also causes, over time, a different degree of wear of the different nozzles, with variation in their section and in the fluid-dynamic characteristics of the traversing flow. The consequences are the impossibility of keeping the phenomenon under control and an unacceptable degradation of the quality characteristics of the homogenized.

The Applicant has now defined a plurality of construction elements of the valve and identified a series of critical relationships between said construction elements which allow to obtain the sought result.

SUMMARY OF THE INVENTION

Therefore, the object of the present invention is to provide a homogenization valve as better specified in the appended claim 1 and in the additional claims dependent therefrom. In particular, the valve comprises at least two distinct homogenization devices arranged in parallel, connected with a same feeding channel and with a same discharge channel.

BRIEF DESCRIPTION OF THE DRAWINGS

Further features and advantages of the invention shall become more readily apparent from the detailed description that follows of a preferred and non limiting embodiment of the invention, with reference to the accompanying drawings, provided purely by way of non limiting example, in which.

DESCRIPTION OF THE PREFERRED EMBODIMENTS

Figure 1:
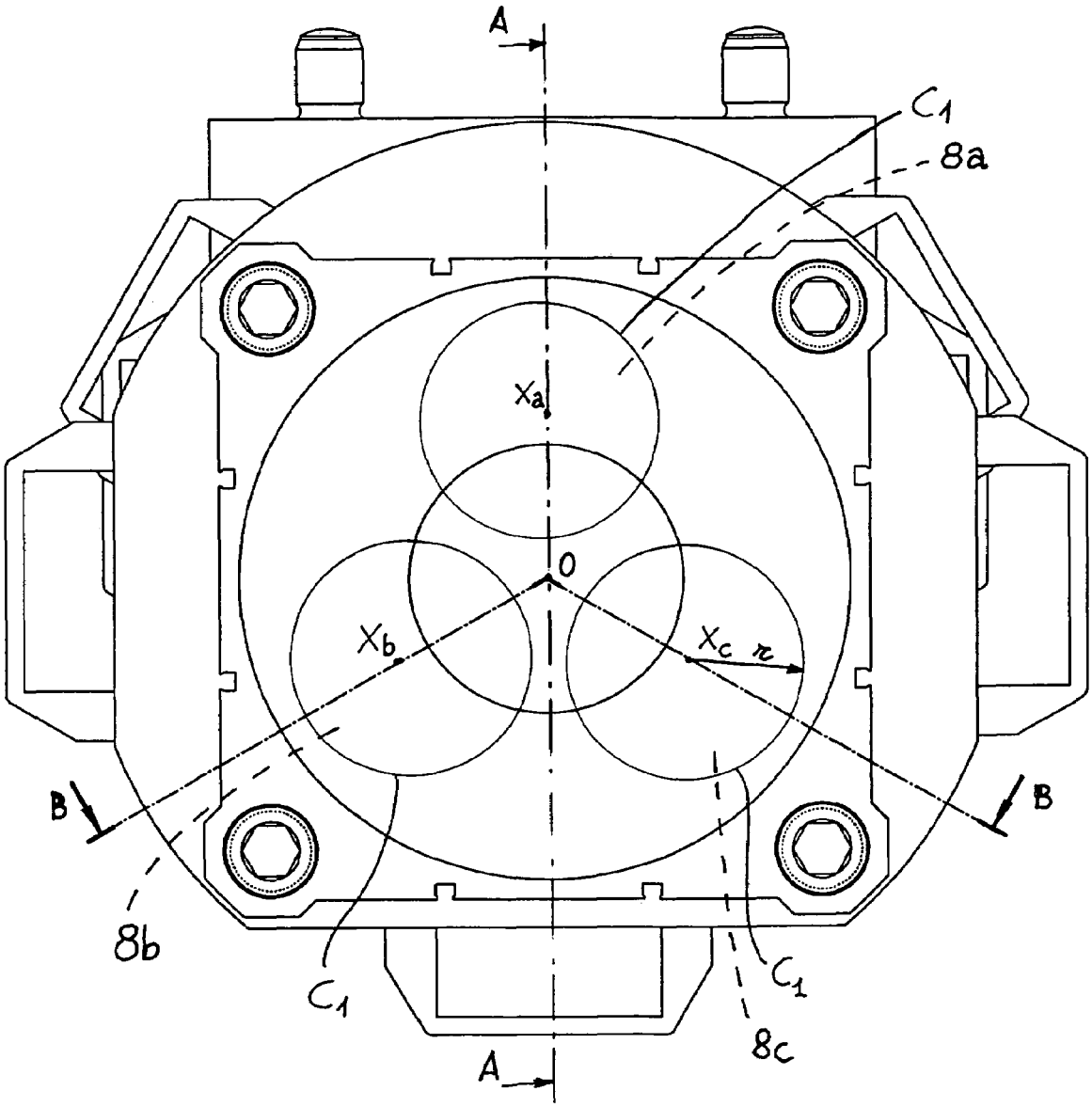
FIG. 1 is a top schematic plan view of a homogenization valve according to the present invention, in the case of the three homogenization devices.

The reference number 1 designates a homogenization valve in accordance with the present invention. FIG. 1 shows the new valve 1 of the invention seen from the top, in plan view. In the preferred embodiment described herein, and without any limitation whatsoever deriving therefrom, the valve 1 comprises an outer case 2, having substantially prism shape, with noticeably quadrangular plan shape, with sides or dimensions of about 20–25 cm of length, in which is contained a homogenization mechanism 3 which will be described in detail below.

Figure 2:
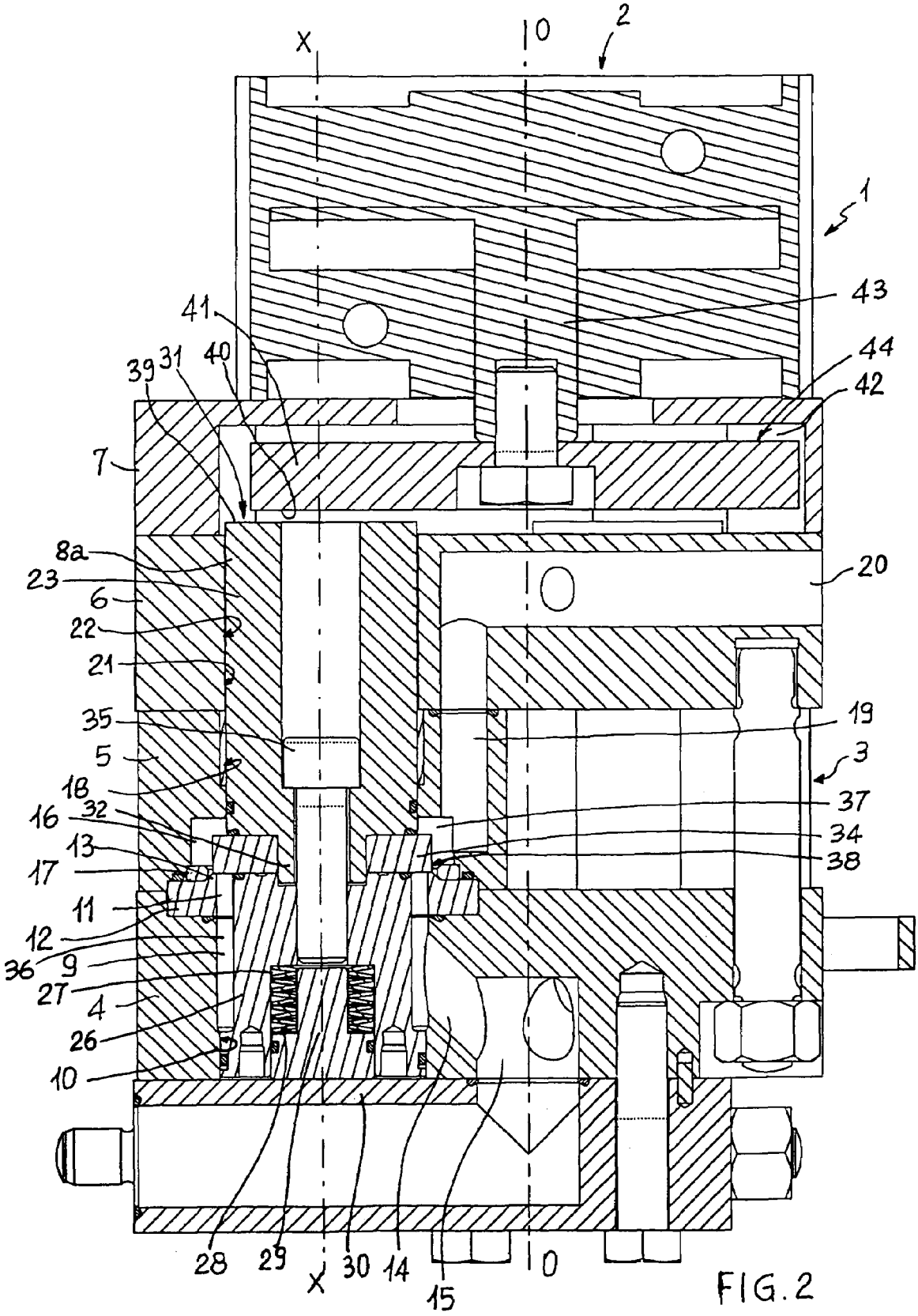
FIG. 2 is a schematic axial section on the plane A—A of FIG. 1 of a homogenization valve according to the invention.
Figure 3:
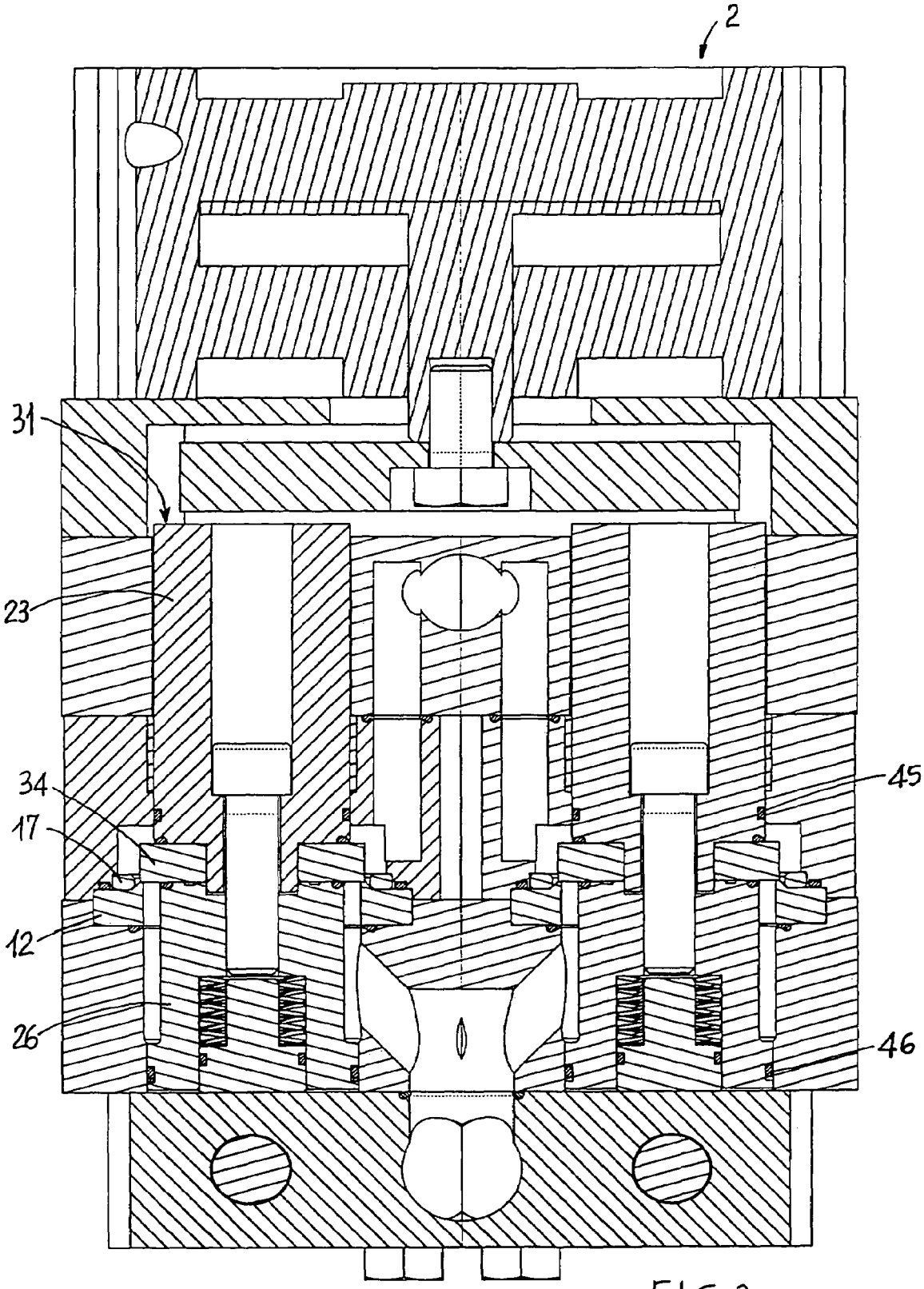
FIG. 3 is a schematic axial section on the plane B—B of FIG. 1 of the homogenization valve of FIG. 2.
Figure 4:
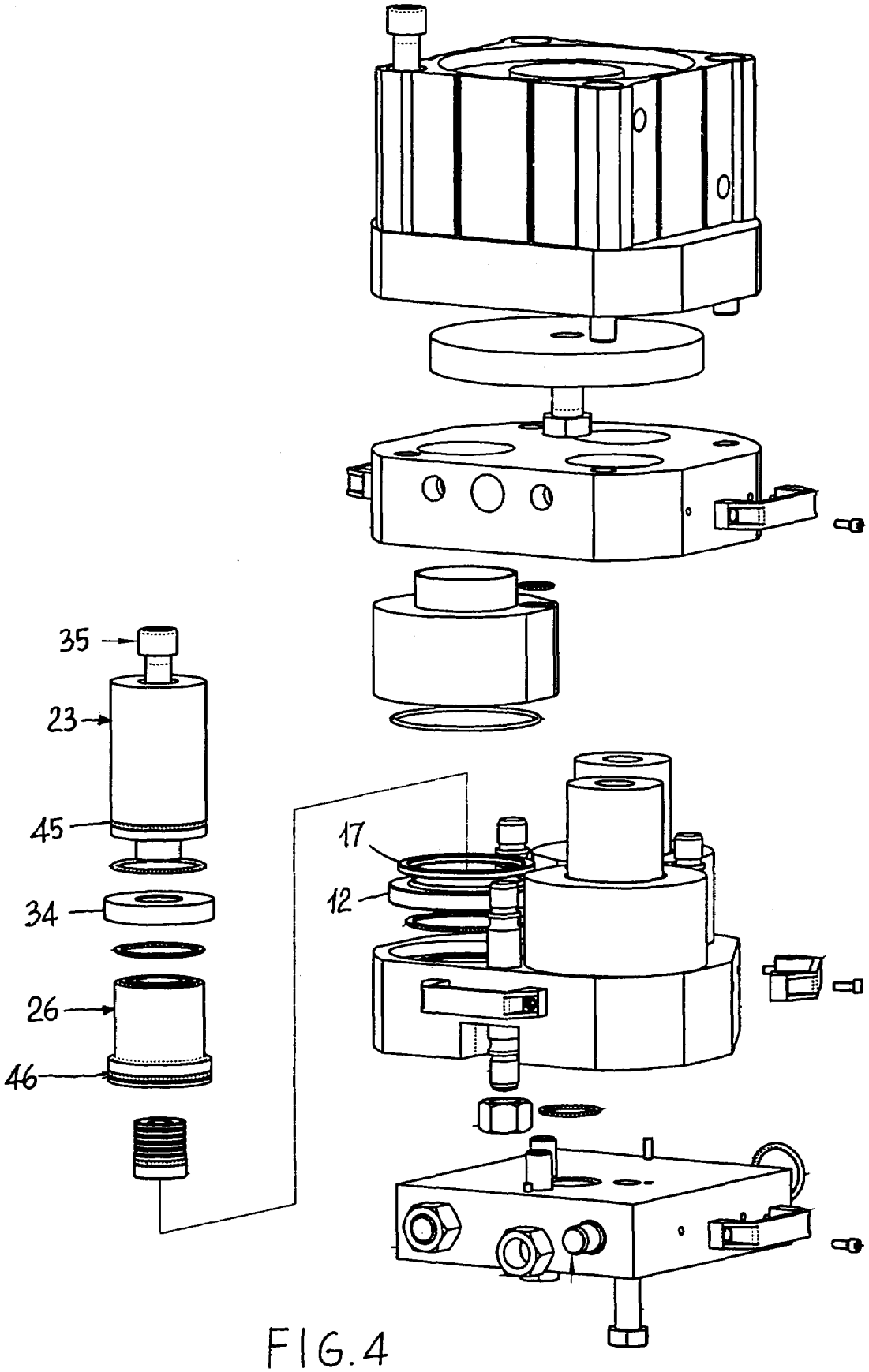
FIG. 4 is an exploded view of the valve.
Figure 5:
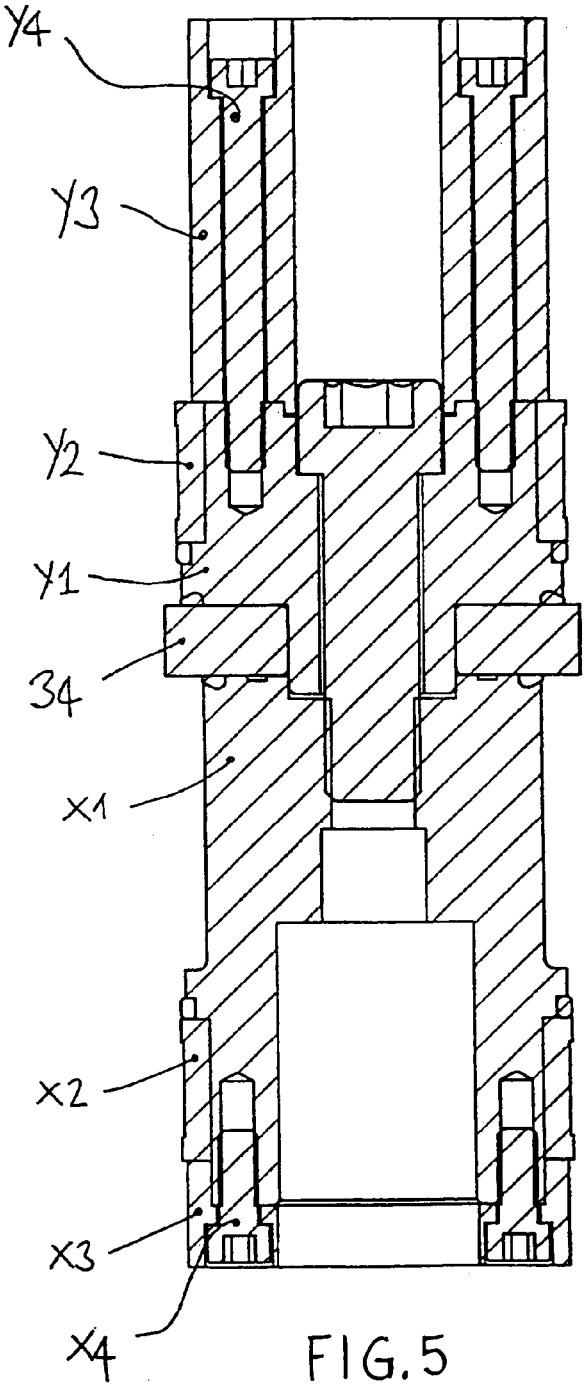
FIGS. 5, 6 and 7 show an embodiment variant of the valve.
Figure 6:
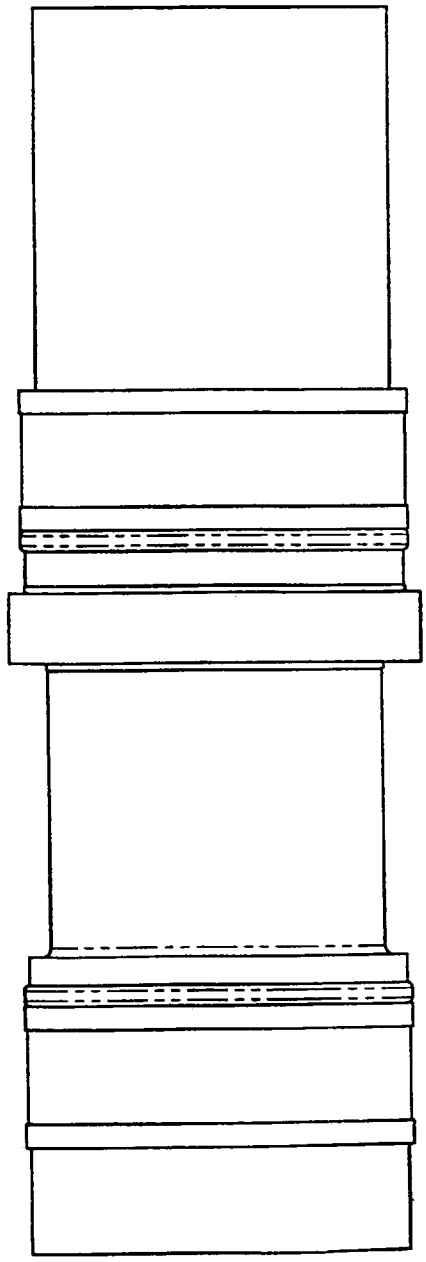
Figure 7:
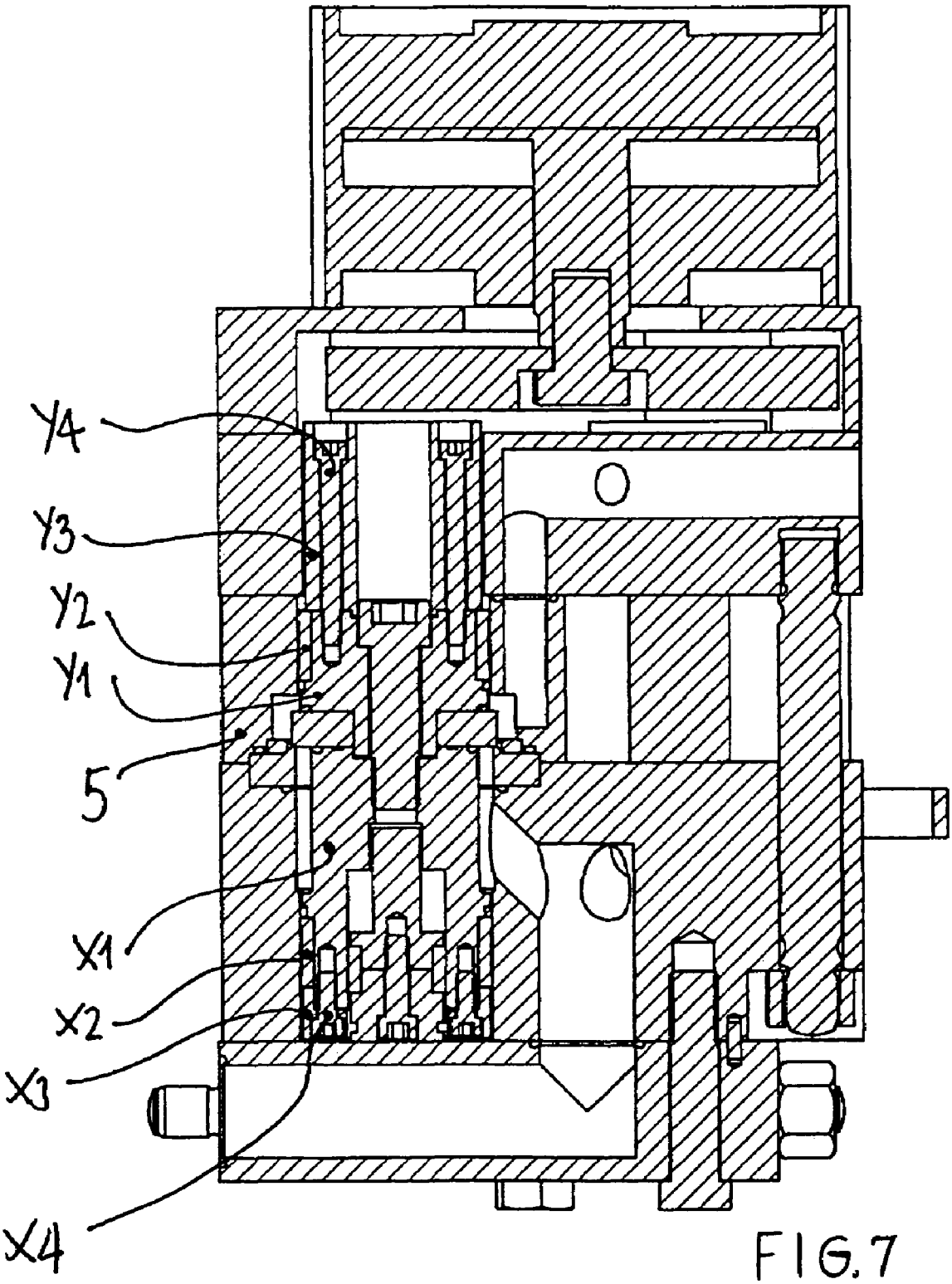

The lines A—A and B—B represent the trace of the section planes of FIGS. 2 and 3. FIGS. 2 and 3 show the valve 1 sectioned respectively according to the planes A—A and B—B of FIG. 1: the case 2 has a height of about 40 cm.

The case 2 comprises a lower distributor valve-body 4 and an upper valve-body 5 for each of the homogenization devices, a manifold body 6 and a spacer head 7 sequentially superposed in the axial direction. In the present description, the term "axial" means the direction of longitudinal development of the valve 1, whose trace is designated by the reference letter "O" in the plane of the FIG. 1; "O" represents the intersection between said plane and the central longitudinal axis O—O. The "axially internal" position is the one oriented downwards in FIGS. 2 and 3, the "axially external" position is the one oriented upwards in the aforesaid figures. The "radial" position is the one perpendicular to the axial direction, the "radially internal" position is the one oriented towards the interior of the case 2, the "radially external" position is the one oriented towards the exterior of the case 2.

Inside said valve-bodies 4, 5 and said manifold body 6 are obtained in the illustrated case three homogenization devices 8*a*, 8*b*, 8*c* circumferentially positioned around said axis O—O, distanced by about 120° from each other and constituting the homogenization mechanism 3. There may also be only two or more than three homogenization devices. Said devices 8*a*, 8*b*, 8*c* have preferably cylindrical shape, with axis X—X parallel to the axis O—O. The bulk of each of the devices 8*a*, 8*b*, 8*c* is represented by a circumference C1 with radius "r" "Xa", "Xb" and "Xc" represent the intersections between the plane of FIG. 1 and the longitudinal axis X—X passing through the center of the circumference C1 of each of the devices 8*a*, 8*b*, 8*c*. The description that follows refers in particular to this preferred embodiment.

With reference to each of said devices 8*a*, 8*b*, 8*c*, the lower valve body 4 comprises a first compartment 9 axially superposed to a second coaxial compartment with smaller diameter designated by the reference number 10: in fact, the reference 10 of FIG. 2 more specifically designates the inner surface of the compartment within which slides a lower piston 26. In axially exterior position to the compartment 9 the lower valve body 4 has a third coaxial compartment 11, whose diameter is greater than that of the first compartment, housing a passage ring or head 12 which has on the axial external, in radially interior position, a projection 13 with reduced radial dimension, preferably tapered in the axial direction. The radially inner surface of said ring 12 is aligned with the surface of the first compartment 9 and together they delimit the radially outer wall of said compartment 9. The axis common to the first, second and third compartment is the aforementioned axis X—X. The first compartment 9 is in communication, through a radial union fitting 14, of preferably circular cross section, with a channel 15 for feeding the fluid to be homogenized, preferably coaxial with the axis O—O. Preferably, the feeding channel 15 has circular cross section.

Preferably, the area of the cross section of the union fitting 14 is at least equal to 1/n of the area of the channel 15, where n is the number of homogenization devices present. The Applicant has found that if a single feeding channel 15 feeds two or more homogenization devices, preferably by means of union fittings 14 which respect the enunciated critical value, the consistency of the fluid feeding pressure and the equality of said pressure in each homogenization device 8*a*, 8*b*, 8*c* even in the case of small and inevitable changes in the feeding flow rate to the valve 1. It should be remembered that the inflow pressure of the fluid into the valve, generated by the partial closure of the elements of the valve itself, can vary and is selected according to fluid type and according to specific homogenization needs for each product. Preferably, the aforesaid union fittings 14 open on said feeding channel 15 in positions that are circumferentially distanced from each other by 120°, or generically by an angle 360°/n, where n is the number of homogenization devices present.

Each of the upper valve bodies 5 comprises a fourth compartment 16 whose diameter is larger than that of the first compartment, which, when the upper valve body 5 is mounted on the lower valve body 4, is also aligned according to the axis X—X. The fourth compartment 16 can widen inferiorly to house an annular crown or impact ring 17, positioned on the axially outer surface of the ring 12. Said impact ring 17 has a slightly smaller radially inner diameter than that of the fourth compartment, but slightly larger than that of a ring 34.

It also has a radially outer diameter that is slightly larger than that of the fourth compartment in such a way as to allow the univocal positioning of the ring 12.

The upper valve bodies 5, present in a number n as a function of the number n of the individual homogenization devices installed in parallel, can also be provided as a single element such as to have the same geometric and functional characteristics as the inner cavities of the individual valve bodies 5.

The fourth compartment 16 narrows in axially outer position, forming a fifth compartment 18 of any diameter, but preferably equal to that of the second compartment, which allows to house a guidance bushing dedicated to guiding without friction the displacement, axial and along the axis X—X of the movable assembly 31 constituted by lower piston 26, impact ring or head 34 and upper piston 23, mutually connected by means of a threaded element 35.

The movable assembly 31 can also be constructed in such as way that both the upper piston 23 and the lower piston 26 are not made in a single piece, but are in turn constituted by a set of elements in order to eliminate any contact between the metallic parts of the pistons and respectively the upper valve body 5 and the lower valve body 4. The lower piston 26 can be constituted by an appropriately contoured cylindrical body X1 provided with a compartment for housing a bushing or bearing X2 made of frictionless material (e.g. a plastic polymer), and in turn blocked by an element X3 mated with X1 and X2 and fastened to X1 by means of a connecting element, such as screws X4. The same holds true for the upper piston 23 which can be constituted by an appropriately contoured cylindrical body Y1 provided with a compartment for housing a bushing or bearing Y2 made of frictionless material (e.g. a plastic polymer), and in turn locked by an element Y3 mated with Y1 and Y2 and fastened to Y1 by means of a connecting element such as screws Y4. In this way the upper valve body 5 does not require the presence of an additional compartment 18 for housing a guiding bushing, since said bushing, identified as Y2, is already integrated in the movable assembly 31.

X2 and Y2, which constitute guiding elements of the movable assembly 31, are integrated therein to prevent contact during its movement between unsuitable metallic surfaces to allow their movement within the lower valve body 4 and the upper valve body 5 without problems with seizing or noisiness.

The fourth compartment 16 or discharge chamber is in communication, through an axial union fitting 19, with a channel 20 for discharging the homogenized fluid, positioned with radial profile within the manifold body 6. Preferably, the discharge channel 20 has circular cross section. The Applicant has found that if a single discharge channel 20 connects the homogenization devices, the equality of the pressure differential between the first compartment 9 and the fourth compartment 16 in each homogenization device is assured, along with the uniformity of the degree of homogenization of the finished product. Preferably, said axial union fittings 19 open onto said discharge channel 20 in positions that are circumferentially distanced from each other by 360°/n.

In the manifold body 6 are also obtained sixth compartments 21, one for each homogenization device 8*a*, 8*b*, 8*c*, with axis X—X and greater diameter than the fifth compartment to allow the axial movement of the movable assembly 31 without contact with the manifold body 6. When the manifold body 6 is mounted on the upper valve body 5, it is also aligned according to the axes O—O and X—X.

The spacer head 7 superiorly closes the case of the valve 1 and constitutes the bearing surface of the pneumatic actuator used to generate the axial thrust force able to produce the homogenization pressure within the valve.

Each group of first 9, second 10, third 11, fourth 16, fifth 18 and sixth 21 compartments, axially aligned according to an axis X—X defines a cavity 22 within which is housed the movable assembly 31, movable in both directions and inferiorly defining an axial cavity 27 within which is housed a contrasting spring 28, working by compression, preferably inserted on a pivot 29 axially projecting from the base 30 of the lower valve body 4. An impact ring or head 34 is applied on an axial protuberance 32 of the upper piston, and it has slightly smaller diameter than the radially inner diameter of the crown 17, which in turn is smaller than the passage head 12. A fastening means 35, such as a screw, mutually assembles in integral fashion the lower piston 26, upper piston 23, and ring 34. The radially outer surface of the lower piston 26 defines the radially inner wall of the first compartment 9. The part of the axially inner surface of the ring 34 that projects from the lower piston 26 defines the ceiling of the first compartment 9. The radially outer surfaces of the upper piston 23 and of the impact ring or head 34 define the radially inner wall of the fourth compartment 16.

The coupling between lower valve body 4 and lower piston 26 defines a high pressure chamber 36 of the homogenization device 8*a*, 8*b*, 8*c*, whilst the coupling between upper valve body 5 and the upper piston 23 defines a low pressure chamber 37 of the aforesaid device 8*a*, 8*b*, 8*c*.

In other words, the lower piston 26 defines with the inner cylindrical surface of the compartment 9 the high pressure chamber 36 and the upper piston 23 defines with the inner surface of the compartment 16 the low pressure chamber 37. The chambers 36, 37 have the shape of cylinders with annular cross section.

An upper O-ring type gasket 45 and a corresponding similar lower gasket 46 contain the area for the passage of the fluid.

The high pressure chamber 36 and the low pressure chamber 37 are separated by an annular gap 38 (blow-by port) defined between the surfaces axially facing each other of the projection 13 and of the ring 34, through which the fluid flows from the first compartment 9 to the fourth compartment 16. C1 and X represents the intersection traces of the gap 38 and of the axis of the devices with the plane of FIG. 1.

Preferably, the axial development of the impact ring 17 is slightly greater than the height of the gap 38, in order to assure a sufficient amplitude of the surface radially facing said gap 38 against which the fluid flowing out of the gap 38 impacts at high speed.

The axial dimension of said port 38 (gap height) is governed by the axial displacement of the piston 23 and more specifically of the axially movable ring (impact head) 34, relative to the fixed passage ring or head 12. It can be noted that the movable assembly 31 is guided in the fifth compartment 18 and in the second compartment 10, i.e. in mutually distanced positions along the axis X—X: in this way, a rigorously axial displacement is assured, free from vibrations and radial thrusts which can compromise the linearity of the motion, and any jams thereof.

An axially outer surface 39 of the upper piston 23 abuts against the axially inner surface 40 of a plate 41, able to slide within a cavity 42 of the spacer head 7, secured to any known device, generally a hydraulic or pneumatic cylinder 43, preferably fastened directly by means of screws to the manifold body 6 by interposition of the spacer head 7, to apply an axial thrust to the plate 41. According to the invention, the plate 41 is operatively active simultaneously on the movable assemblies 31 of all the devices 8*a*, 8*b*, 8*c*. The plate 41 and the hydraulic or pneumatic cylinder 43 are means 44 for actuating the movable assemblies 31 that control the amplitude of the blow-by port. The Applicant has intuited that only the centralized control of the force applied by the plate 41, antagonistic with the elastic reaction exerted by the contrast spring 28 on each movable assembly 31, allows to maintain the height of the gap 38 constant in all devices 8*a*, 8*b*, 8*c*. The aforesaid height is the one resulting from the condition of equilibrium between the thrust of the force applied to the axially outer end of the movable assembly 31 and the elastic reaction exerted by the contrast spring 28 on the axially inner end of the aforesaid movable assembly 31.

The invention achieves many important advantages.

Note that the flow rate of the vale of the invention is given by the sum of the flow rate of the individual devices and the flow rate of each devices is determined by the cross section of the passage gap, multiplied times the velocity of the flow, in turn determined by the difference in pressure between the two chambers, respectively at high and low pressure. The cross section of the passage gap is given by the product of the linear development of the gap times its height, so that, all other conditions being equal, it depends only on its linear development. Note that the linear development of the gap of each device corresponds to the perimeter of the cylindrical surface with diameter D1, i.e. to the circumference C1. The circumference C1 is always greater than one $n^{th}$ the effective circumference of the maximum known valve dimension (for instance with a diameter of about 137 mm, but which can also have additional dimensional variants), since the diameter of C1 is for example equal to about 83 mm, but it may also have further dimensional variants according to the dimensioning requirements of the valve of the present invention for n equal to or greater than 2.

In conclusion, the flow rate of the valve of the invention can greatly increase the flow rate of the equivalent known valve for the same axial fluid passage distance between passage head 12 and impact head 34; in the case of n=3, the increase of the passage surface is about 80%. Moreover, for a given flow rate, since the sum of the different C1 values is large relative to the C of the traditional valve, the height of the gap can be reduced further, thereby improving homogenization efficiency.

The valve is very compact and its limited greater weight as well as its low greater cost, because of the complexity due to the presence of multiple homogenization devices instead of the single previous mechanism, are amply offset by the achieved advantages.

In the present description, all possible structural and cinematic alternatives to the embodiments of the invention specifically described herein have not been illustrated. However, they are understood to be equally included within the scope of protection of the present invention, since such alternative embodiments are in themselves easily identified by the description provided herein of the relationship that links each embodiment with the result the invention sets out to achieve, because the intention is to stress the modularity of the adopted solution which in principle may comprise a number n of homogenization devices operating in parallel and under the same conditions of differential pressure each on an $n^{th}$ portion of the total portion that traverses the device.

What is claimed is:

1. A homogenization valve comprising:

an outer case;

a homogenization mechanism contained in the outer case and having at least two homogenization devices; said at least two homogenization devices defining a high pressure chamber in communication with a channel for feeding a fluid under high pressure to be homogenized, a low pressure chamber in communication with a channel for discharging the homogenized fluid under low pressure; said high pressure chamber being in communication with said low pressure chamber through a blow-by port of said fluid;

means for actuating movable assemblies that control a height of a working gap of the blow-by port of said fluid; and wherein said at least two homogenization devices are connected with a same feeding channel and with a same discharge channel, and wherein said at least two homogenization devices define correspondent distinct and coplanar annular gaps, serving as ports for the blow-by of the fluid.

2. A valve as claimed in claim 1, wherein said at least two homogenization devices have a cylindrical shape and are circumferentially positioned about a central axis, distanced from each other by 360°/n, where n is the number of homogenization devices.

3. A valve as claimed in claim 1, wherein each of said at least two homogenization devices has:

a movable assembly housed in a cavity of the outer case and having a lower piston defining with the inner surface of a compartment the high pressure chamber and an upper piston defining the low pressure chamber with the inner surface of an additional compartment; said chambers having the shape of cylinders with annular cross section;

a ring or impact head, radially projecting from the lateral surface of said movable assembly and at least partially superposed to a projection of a passage head, defines a blow-by port together with said projection.

4. A valve as claimed in claim 3, wherein said movable assembly is capable of axially sliding in both direction within said cavity, constituted by various elements with a cylindrical cavity superposed according to a longitudinal axis, by said actuating means, to control the amplitude of the blow-by port.

5. A valve as claimed in claim 4, wherein said actuating means has a hydraulic or pneumatic cylinder, connected to a plate that is operatively active on the movable assembly of all the devices.

6. A valve as claimed in claim 1, wherein the at least two homogenization devices are connected to the feeding channel by means of radial union fittings facing said feeding channel in positions that are circumferentially distanced from each other by 360°/n, where n is the number of homogenization devices.

7. A valve as claimed in claim 1, wherein the at least two homogenization devices are connected to the discharge channel by means of axial union fitting facing said discharge channel in positions that are circumferentially distanced from each other by 360°/n, where n is the number of the homogenization devices.

8. A valve as claimed in claim 1, wherein said feeding channel is centrally positioned.

9. A valve as claimed in claim 1, wherein each of said movable assemblies comprises an upper piston and a lower piston, which, in turn, comprise a set of elements.

10. A valve as claimed in claim 9 wherein the set of elements in the case of the lower piston comprises: an appropriately contoured cylindrical body provided with a compartment for housing a bushing or bearing made of frictionless material and locked in turn by an element mated with the cylindrical body and the bushing and fastened to the cylindrical body by means of a connecting element; and in the case of the upper piston it comprises an appropriately contoured cylindrical body provided with a compartment for housing a bushing or bearing made of frictionless material and locked in turn by an element mated with the cylindrical body and the bushing and fastened to the cylindrical body by means of a connecting element.

11. A valve as claimed in claim 9 wherein elements for guiding the movable assembly are integrated therein to prevent the contact between metallic surface during its motion.

* * * * *